United States Patent [19]

Porat

[11] 4,174,060

[45] Nov. 13, 1979

[54] DETACHABLE PAPER BAG CARRIER

[76] Inventor: David Porat, 17 Englewood Ave., Brookline, Mass. 02146

[21] Appl. No.: 803,242

[22] Filed: Jun. 3, 1977

[51] Int. Cl.[2] ..... B65D 71/00

[52] U.S. Cl. ..... 224/45 H; 294/103 R

[58] Field of Search ..... 224/45 BA, 45 H, 45 P, 224/50; 294/102 R, 103 R, 27 R; 229/52 A, 62, 68 C; 24/18

[56] References Cited

U.S. PATENT DOCUMENTS

| | | | |
|---|---|---|---|
| 824,904 | 7/1906 | Commett et al. | 294/103 R |
| 1,976,848 | 10/1934 | Ham | 294/103 R |
| 2,559,223 | 7/1951 | Murray | 294/102 R |
| 3,780,923 | 12/1973 | Merola | 294/102 R |

FOREIGN PATENT DOCUMENTS

| | | | |
|---|---|---|---|
| 1300131 | 6/1962 | France | 224/45 H |

*Primary Examiner*—Robert J. Spar
*Assistant Examiner*—Kenneth W. Noland
*Attorney, Agent, or Firm*—Kenyon & Kenyon

[57] ABSTRACT

A detachable paper bag carrier comprising a handgrip connected to two paper clamps. Each clamp comprises a front plate, a top member and two side plates, which leave a channel into which a side of a paper bag may be inserted and which bound a volume of space in which a travelling plate is located. The travelling plate is caused to move by the insertion of the paper bag and retains the paper bag until it is manually released.

4 Claims, 4 Drawing Figures

DETACHABLE PAPER BAG CARRIER

BACKGROUND OF THE INVENTION

This invention relates to package and article carriers and particularly to reusable carriers that are adapted to carry paper bags.

In general there are many devices known which can be permanently adhesively fixed to a sack or paper bag in order to make it more convenient for a shopper to carry such packages home. Those devices typically adhere to the paper over a relatively large surface area and are therefore able to distribute the large stresses produced when for example a bag is full of groceries. Some very familiar detachable devices engage strings that encircle the package to be carried and through the agency of the strings distribute the stress to the sides and bottom of the parcel. See for example U.S. Pat. No. 824,904.

In order to provide a paper bag carrier of moderate size one is confronted by the substantial stresses that will be produced in the immediate vicinity of the carrier. This problem is further complicated by the fact that any irregularity or roughness used to retain the paper from slipping provides points or lines at which stresses concentrate. Such points or lines induce fractures in the paper which can propagate a rip along the paper. It was not known in the prior art how to adapt a device to contain the paper fractures before they could propagate out of the region of support provided by the carrier.

Furthermore, the prior art is characterized by mechanically complex gripping apparatus for the carrying of planar materials. For example, U.S. Pat. Nos. 3,653,708 and 3,780,923 employ difficult to manufacture counterrotating rollers retained in movable axles between converging support members; U.S. Pat. No. 1,121,130 employs a running gear retained in a sliding bracket within converging support members; U.S. Pat. No. 489,782 employs a double excentrically pivoted and serrated wheel. Each of those prior art apparatus is further distinguished by the fact that the surfaces which actually bear on the materials to be carried are small in area. This limitation is believed to have been necessary in the prior art due to the tendency of apparatus which has large material retaining surfaces to jam and to be difficult to disengage after the material has been transported.

The limitation to small contact surface areas makes unsuited for paper bag carriers such devices as exist in the prior art for retaining rods or wires, such as for example as disclosed in U.S. Pat. Nos. 801,377; 3,576,057 or 2,106,373.

The prior art is further characterized by heavy unwieldy construction unsuitable for carriers that could be used by a supermarket patron or carried conveniently in a pocket or purse when not in use.

SUMMARY OF THE INVENTION

The present invention solves the above noted problems by providing a mechanical apparatus that is simple to produce and operate, which has relatively large surface areas in contact with the paper bag to be carried which reduces the tendency of the paper to tear and which makes it convenient to carry even heavily loaded parcels without fear of them slipping or tearing from the carrier. It should, of course, be understood that other articles than paper bags, for example, cloth bags or other paper objects may be carried. Also the paper clamps of the present invention may be used singly.

The invention comprises a mechanical arrangement that provides large pressure bearing surfaces adapted to retain an inserted bag without tearing. The pressure on the paper automatically increases with the weight of the load. At the same time the device is easily detached even after the highest pressure has been brought to bear.

The invention also comprises a unique arrangement of embossing points on the pressure plate which distribute stresses in a manner that restrains tearing.

The features that facilitate the easy assembly of the carrier comprise separately machined or stamped front, top and side members and a travelling plate which bears against the front plate to retain the paper.

DETAILED DESCRIPTION OF THE PREFERRED EMBODIMENT

Figure 4:
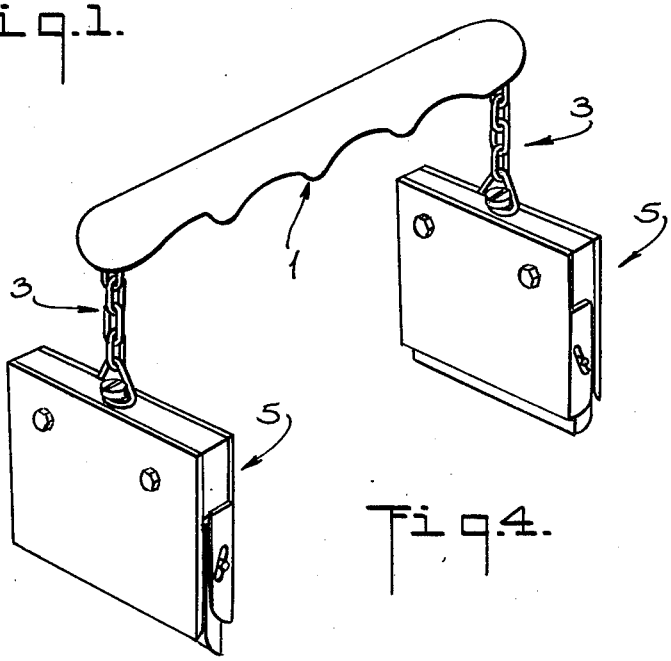
FIG. 4 is a perspective view of the preferred embodiment of the invention having a handle and two clamps.

As indicated in FIG. 4, the preferred embodiment of the invention comprises a handgrip 1 fixedly connected to two cords or chains 3, which are attached at their other end to clamps, generally designated as 5. The preferred embodiment of the clamp is shown in greater detail in FIG. 1.

Figure 1:
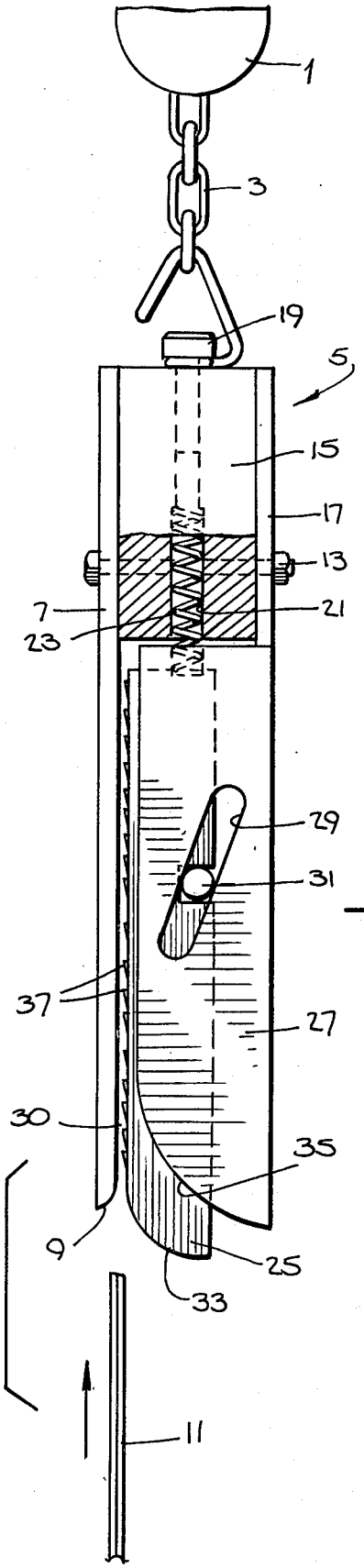
FIG. 1 is a side view of the preferred embodiment of the clamp portion of the invention.

As shown in FIG. 1 in side view, a rectangular front plate 7 having longer side edges of about 1½ inches and a shorter bottom edge of about 1 inch has its bottommost edge 9 bevelled to form a lip that will be convenient to the insertion of paper or other sheetlike fragile materials shown generally as 11. The front plate 7 is fastened by two nuts and bolts 13 to a spacer member 15 and a rectangular back plate 17. The front plate 7, spacer member 15 and back plate 17 provide strength and rigidity to the clamp and are preferably made of aluminum or some other light metal. The rectangular back plate 13 preferably has the same dimensions as the front plate 7.

The spacer member 15 is preferably drilled and topped on its top to receive a fastening screw 19 which joins the clamp to the handle via the cord 3. The bottom face of the spacer member is drilled to provide a recess 21 to retain a helical spring 23, which will provide pressure on the travelling plate 25 to keep it in its disengaged position when no load is being carried.

The spacer preferably has the same width as the front and back plates so that their upper surfaces are flush. This is believed to give the greatest strength while keeping weight to a minimum. The rectangular parallelopiped shape of the spacer member 15 assures that the front and back plates are parallel.

Two side plates 27 are rigidly attached to the back plate as by welding. It is also possible to form the back plate and side plates by stamping them out of one piece of material or making them out of one solid piece of metal using standard techniques. The side plates are mirror images of one another, and are parallel to each other and perpendicular to the back plate. The width of the side plate is such as to leave an open channel between the front plate and the side plate. It is into this channel that the material to be carried is inserted. The width of the channel 30 should be appropriate to the material, and for paper a width of about 1/16 inch is appropriate. The side plates each have a channel 29 cut in them, which runs diagonally upwards and away from the channel 30.

The travelling plate 25 conforms generally to the shape of the volume of space between the front plate, spacer, back plate and side plate, except that it is thinner by an amount equal to the horizontal displacement of the channel 30.

The travelling plate 25 has protrusions 31 which ride in the channels 29 and assure that as the travelling plate moves downward it more firmly engages the front plate 9. The travelling plate and the side plates have convex arcs 33, 35 formed on their lower edge to facilitate the insertion of the paper material.

In operation the clamp is fitted over the edge of a paper bag, which enters the channel 30 and pushes the travelling plate 25 upwards against the spring 23 until under the guidance of the protrusions 31 riding in the channel 29 the travelling plate moves away from the front plate permitting the paper to enter.

Figure 3:
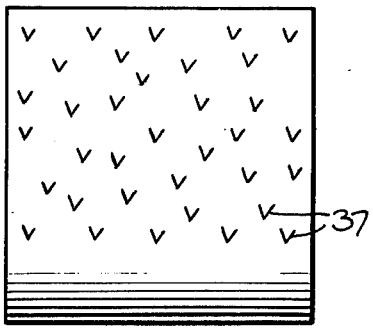
FIG. 3 is a front view of the embossed design on the pressure plate of the preferred embodiment.

When the handle 1 is grasped and raised, the paper is engaged by the embossed protrusions 37 on the travelling plate, which forces the travelling plate downwards and against the front plate. These are further shown in FIG. 3.

In order to distribute the stresses in a manner that will not tear the paper, the travelling plate remains substantially parallel to the front plate, and the embossed pattern has a non-regular pattern to break up lines of tension. As an alternative the embossed pattern may be raised on the inner surface of the front plate.

Figure 2:
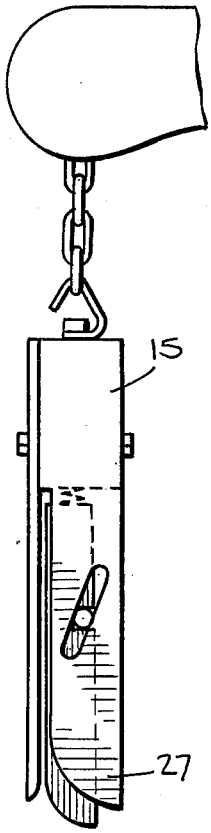
FIG. 2 is a side view of an alternative embodiment in which there is no back plate element.

FIG. 2 shows an alternative embodiment in which the side plates 27 are fixed to or formed integral with the spacer element 15. This allows one to dispense with the back plate 17 with a gain in lightness.

In operation after transporting its load, the apparatus may be detached by supporting the load from beneath and manually raising the protrusions 31 to free a jam if necessary.

I claim:

1. A detachable paper clamp comprising (a) a front plate having an inner face;

(b) a top member fixedly attached to a portion of the inner face of the front plate;

(c) two side plates fixedly attached to the top member whereby a volume of space is bounded on four sides by the inner face of the front plate, the top member and the two side plates, said side plates leaving a channel between the inner face of the front plate and the edges of the side plate sufficiently wide to receive an upper end of a paper bag, each of said side plates further having a recess through its faces oriented on a diagonal upwards towards the top member and away from the inner face of the front plate;

(d) a travelling plate located within the volume of space, and having a protrusion on each of its two sides that slidably engages the recesses in the side plates, said travelling plate having a face substantially parallel to the inner face of the face plate, whereby the insertion of the upper end of a paper bag between the front plate and the travelling plate causes the travelling plate to move upwards and away from the inner face of the front plate until the upper end of the paper bag is substantially within the space between the inner face of the front plate and the face of the travelling plate and the paper bag will be so retained on the carrier when the travelling plate moves downwardly and towards the front plate to engage the paper bag.

2. A detachable paper bag carrier comprising a handgrip flexibly attached to a plurality of paper clamps, each said clamp comprising (a) a front plate having an inner face;

(b) a back plate;

(c) a spacer member fixedly attached to the front and back plates between a portion of the inner face of the front plate and a portion of one face of the back plate, whereby a volume of space is bounded on three sides by the inner face of the front plate, the spacer member and one face of the back plate;

(d) two side plates fixedly attached to the back plate and bounding two other sides of said volume of space, said side plates leaving a channel between the inner face of the front plate and the edges of the side plate sufficiently wide to receive an upper end of a paper bag, each of said side plates further having a recess oriented on a diagonal upwards towards the spacer member and away from the inner face of the front plate; and (e) a travelling plate located within the volume of space, and having a protrusion on each of its two sides that slidably engages the recesses in the side plates, said travelling plate having a roughened face substantially parallel to the inner face of the face plate, whereby the insertion of the upper end of a paper bag between the front plate and the travelling plate causes the travelling plate to move upwards and away from the inner face of the front plate until the upper end of the paper bag is substantially within the space between the inner face of the front plate and the roughened face of the travelling plate and the paper bag will be so retained on the carrier when the travelling plate moves downwardly and towards the front plate to engage the paper bag.

3. A detachable paper bag carrier according to claim 2 wherein said roughened face has an irregular pattern of embossed protrusions thereon.

4. A detachable paper bag carrier comprising a handgrip having cords with two ends respectively extending therefrom and each said ends having fixedly attached thereto a slender, lightweight paper clamp comprising (a) a rectangular front plate having longer side edges and shorter top edge and a bottom edge wherein said bottom edge is rounded onto one face to form a bevelled lip, said face hereinafter referred to as said inner face;

(b) a rectangular back plate having longer side edges and shorter top edge and a bottom edge;

(c) a rectangular spacer member having two end faces, a top face fixedly attached to one end of the abovementioned cords, a bottom face having therein a recess adapted to receive a helical spring extending therefrom, a left side face fixedly attached to a portion of the inner face of the front plate, and a right side face fixedly attached to a portion of one face of the back plate, such that the top edge of the front plate is substantially contiguous with the top face of the spacer member, a portion of the side edges of the front plate is substantially contiguous with the two end faces of the spacer member, and the back plate is substantially parallel to the front plate, whereby a substantially rectangular space is bounded on three sides by the inner face of the front plate, the bottom face of the spacer member and one face of the back plate;

(d) two side plates being mirror images of each other fixedly attached to the back plate so that said side plates are parallel to each other, perpendicular to the back plate and bounding two more other sides of said rectangular space, said side plates leaving a channel between the inner face of the front plate and the edges of the side plate sufficiently wide to receive an upper end of a paper bag, said side plates further having a convex arc at the corner most closely opposite the bevelled lip of the front plate whereby the insertion of the upper end of a paper bag is facilitated, each of said side plates further having a slot passing through its faces oriented on a diagonal from the convex arc towards the spacer member and away from the inner face of the front plate;

(e) a substantially rectangular travelling plate located within the rectangular space, having a protrusion on each of its two sides that slidably engages the slots in the side plates, said travelling plate having a roughened face substantially parallel to the inner face of the face plate, a recess in its top face to receive the end of the helical spring extending from the spacer member, said travelling plate having its lower end face rounded to form a bevelled lip, and said lower end face engages a serrated face of said travelling face, whereby the insertion of the upper end of a paper bag between the front plate and the travelling plate causes the travelling plate to move upwards against the helical spring and away from the inner face of the front plate until the upper end of the paper bag is substantially within the space between the inner face of the front plate and the serrated face of the travelling plate and the paper bag will be so retained on the carrier when the travelling plate moves downwardly and towards the front plate to engage the paper bag.

* * * * *